US009273542B2

(12) United States Patent
Kaiser et al.

(10) Patent No.: US 9,273,542 B2
(45) Date of Patent: Mar. 1, 2016

(54) METHOD FOR CONTROLLING FLUID INTERFACE LEVEL IN GRAVITY DRAINAGE OIL RECOVERY PROCESSES WITH CROSSFLOW

(71) Applicant: Noetic Technologies Inc., Edmonton (CA)

(72) Inventors: Trent Michael Victor Kaiser, Edmonton (CA); Spencer P. Taubner, Edmonton (CA)

(73) Assignee: NOETIC TECHNOLOGIES INC., Edmonton (CA)

( * ) Notice: Subject to any disclaimer, the term of this patent is extended or adjusted under 35 U.S.C. 154(b) by 119 days.

(21) Appl. No.: 14/093,456

(22) Filed: Nov. 30, 2013

(65) Prior Publication Data

US 2014/0083692 A1 Mar. 27, 2014

Related U.S. Application Data

(63) Continuation-in-part of application No. PCT/CA2012/000516, filed on Jun. 1, 2012.

(60) Provisional application No. 61/492,618, filed on Jun. 2, 2011.

(51) Int. Cl.

| | |
|---|---|
| ***E21B 47/00*** | (2012.01) |
| ***E21B 49/00*** | (2006.01) |
| ***E21B 43/16*** | (2006.01) |
| ***E21B 43/24*** | (2006.01) |
| ***E21B 47/06*** | (2012.01) |

(52) U.S. Cl.

CPC ..... *E21B 43/162* (2013.01); *E21B 43/2406* (2013.01); *E21B 47/065* (2013.01); *E21B 47/00* (2013.01); *E21B 49/00* (2013.01)

(58) Field of Classification Search

CPC ..... C09K 8/035; C09K 8/24; C09K 8/473; C09K 8/62; C09K 2208/00; E21B 43/26; E21B 43/24; E21B 21/08; E21B 43/2406; E21B 43/247; E21B 47/06; E21B 49/08; E21B 2043/0115; E21B 43/16; E21B 43/305

See application file for complete search history.

(56) References Cited

U.S. PATENT DOCUMENTS

| | | | | |
|---|---|---|---|---|
| 5,389,267 | A * | 2/1995 | Gorelick et al. | 210/758 |
| 2006/0015310 | A1* | 1/2006 | Husen et al. | 703/10 |
| 2014/0278112 | A1* | 9/2014 | Nelson | 702/12 |

* cited by examiner

*Primary Examiner* — Zakiya W Bates
(74) *Attorney, Agent, or Firm* — Donald V. Tomkins

(57) ABSTRACT

In a method for controlling interface level between a liquid inventory and an overlying steam chamber in a subterranean petroleum-bearing formation, an inflow relationship is developed to predict the vertical position in a gravity field of the interface between the two fluids (liquid and steam) with a density contrast relative to a horizontal producer well. The inflow relationship is applied to producer well completions by designing the completion to raise or lower sand face pressures according to mobility variations over the horizontal length of the well. This pressure distribution will affect liquid levels according to the inflow relationship. The completion can include tubing-conveyed or liner-conveyed flow control devices to create flow network that provides a customized sand face pressure distribution. Axial flow relationships between adjacent locations along the producer well may be modeled in order to develop an axial flow network to facilitate estimation of liquid levels at selected locations.

5 Claims, 5 Drawing Sheets

METHOD FOR CONTROLLING FLUID INTERFACE LEVEL IN GRAVITY DRAINAGE OIL RECOVERY PROCESSES WITH CROSSFLOW

FIELD OF THE DISCLOSURE

The present disclosure relates to methods for improving recovery of hydrocarbons from subterranean formations. More specifically, the disclosure relates to a method of controlling the fluid interface level above a horizontal producer well to effect the inflow of oil-bearing production fluids from the reservoir and to avoid breakthrough of gases into the producer well.

BACKGROUND

Gravity drainage processes are used for extracting highly viscous oil ("heavy oil") from subterranean formations or bitumen from oil sand formations. For purposes of this patent specification, the general term "oil" will be used with reference to liquid petroleum substances recovered from subterranean formations, and is to be understood as including conventional crude oil, heavy oil, or bitumen, as the context may allow or require.

For heavy oil or bitumen to drain from a subterranean formation by gravity, its viscosity must first be reduced. The Steam-Assisted Gravity Drainage (SAGD) process uses steam to increase the temperature of the oil and thus reduce its viscosity. Other known gravity drainage processes use solvents or heat from in-situ combustion to reduce oil viscosity.

SAGD uses pairs of horizontal wells arranged such that one of the horizontal wells, called the producer, is located vertically below a second well, called an injector. The vertical distance between the injector and producer wells is typically 5 meters (5 m). The horizontal section of a SAGD well is typically 700 m to 1500 m long. For SAGD projects in the Athabasca oil sands in Alberta, Canada, the depth of the horizontal section is typically between 100 m and 500 m from the surface. Bitumen recovery from the oil sands is accomplished by injecting steam into the injector wellbore. Steam is injected from the injector wellbore into the hydrocarbon-bearing formation, typically through slots or other types of orifices in the injector wellbore liner. The steam permeates the formation within a region of the formation adjacent to the injector well; this steam-permeated region is referred to as a steam chamber. As steam is continuously injected into the formation, it migrates to the edges of the steam chamber and condenses at the interface between the steam chamber and the adjacent region of the bitumen-bearing formation. As the steam condenses, it transfers energy to the bitumen, increasing its temperature and thus decreasing its viscosity, ultimately to the stage where the bitumen becomes flowable, whereupon the mobile bitumen and condensed water flow down the edges of the steam chamber, accumulating as a "liquid inventory" in a lower region of the steam chamber and flowing into the producer wellbore. The fluid mixture of flowable bitumen and water that enters the producer well is then produced to the surface.

A significant challenge encountered by operators of SAGD well pairs is controlling the inflow distribution of oil and water over the horizontal length of the producer well, or the outflow distribution of steam, solvents, or combustion gases from the horizontal injector well. In many cases, inflow distributions or steam outflow distributions are biased towards one part of the well—for example, the region near the heel of the well (i.e., where the horizontal producer well transitions to a vertical well to the surface) or the region near the toe of the well. This results in less favourable well economics due to ineffective use of injection fluid (i.e., steam), poor bitumen recovery rates, and low recovery factors (i.e., when parts of the reservoir are not produced). The inflow/outflow biasing is influenced by the reservoir geology, which is largely outside the control of the well operator.

Another important factor influencing inflow and outflow distributions is the sand face pressure distribution along the length of the injector or producer well resulting from wellbore hydraulics. In this context, "sand face" refers to the point where flow emerges from the sand pack. In oil sands, the sand packs around the liner and flow emerges from the point where the sand is retained by the liner and flows into the gaps of the sand screen. The well operator has some control over this factor by means of the well completion design. For a typical injector well injecting steam into the formation through a slotted liner, wellbore steam pressures are highest near the heel and decrease towards the toe due to fluid friction pressure losses in the axial direction of the wellbore. Where wellbore pressures are higher at the heel, greater outflows of steam, solvent, or other injected gas are present. To equalize or create preferential outflow distributions, Dall'Acqua et al. have proposed (in International Application No. PCT/CA2008/000135) an injector completion with a tubing string run inside a liner, whereby the tubing string has ports located along its length that are sized and positioned to create a uniform or preferential sand face pressure distribution over the length of the injector well. The pressure distribution could be customized to achieve preferential outflow distributions into reservoirs with varying mobility (due to varying formation permeability, for example).

The experience of SAGD well operators in Alberta has shown that the performance of gravity drainage wells is affected by both injector and producer completion designs. In some cases, the producer completion has been shown to have a more significant effect on well performance. A method of controlling inflow distributions over the length of a long horizontal producer well is needed. Producer well design requires consideration of additional complexities that are not factors for injector well design. The fluid interface level relative to the producer needs to be managed carefully to both maximize production rates and to protect the producer well from breakthrough of injection gases. Breakthrough of steam into the producer will damage the well and/or related facilities, and breakthrough of other injection gases (e.g., light hydrocarbons such as propane and butane) reduces the efficiency of their function to mobilize bitumen.

The fluid interface (i.e., the interface between the liquid inventory and the overlying steam chamber) is characterized by a density contrast between the injection fluid (typically steam) and the produced oil and water. For purposes of this patent specification, the fluid interface level will be alternatively referred to as the "liquid level". It is preferred to let the liquid level sit a short distance above the producer well to act as a seal preventing steam from entering the producer well. If steam is allowed to enter the producer, the steam is not being used for heating bitumen and the process becomes less efficient. Steam entering the producer well can also carry sand particles at high speeds and cause erosion of the steel liners and tubing strings in the wellbore.

To evaluate the economics of an oil recovery project, an estimate of the recovery rate is required. For conventional oil wells, an inflow performance relationship (IPR) is used to predict the oil recovery rate for the reservoir pressure and bottom hole pressure conditions expected. In this sense, conventional oil production is driven by pressure not gravity.

Therefore, IPRs as used for conventional oil wells cannot be applied to gravity drainage projects, so a gravity drainage inflow performance relationship (GIPR) is needed to estimate the economics of the process.

"Thermal Recovery of Oil and Bitumen" (R. Butler, 1997, 3rd edition, printed by GravDrain Inc., ISBN 0-9682563-0-9) presents formulas for predicting SAGD recovery rates for a given liquid head, or difference in height between the top of the steam chamber and the producer well. The calculation is based on a two-dimensional cross-section of the well and reservoir. Two other factors will affect SAGD production rates that are not covered in these calculations. Firstly, Butler's calculation assumes that the liquid level contacts the top of the producer well. In actuality, it is typical for liquid levels to sit above the producer wellbore forming a liquid "trap" that the producer wellbore is submersed in. As bitumen and water flow through the liquid trap to the producer well, pressure loss will occur. Many SAGD operators have observed significant pressure losses in this region, with resultant reduction in actual production rates relative to predicted rates. While exact causes for these pressure losses are not fully known, they are sometime attributed to two-phase flow (relative permeability) effects, plugging of slotted liners, fines migration, or other causes.

Another important consideration for predicting SAGD production rates is that wellbore pressures and temperatures vary along the length of a long horizontal well. This will cause liquid levels, and thus the depth of the liquid trap, to also vary along the length of the well, which in turn will affect the total production rate from the well. Near-wellbore reservoir heterogeneities (i.e., permeability variations close to the wellbore) will also contribute to inflow variations along the length of the well.

BRIEF SUMMARY OF THE DISCLOSURE

The present disclosure teaches methods for predicting or characterizing an inflow relationship that relates the vertical position of the liquid level to the position of a producer well. This inflow relationship is applied to producer completion design to select wellbore tubular and flow control equipment that will influence the pressure profile along the length of the producer well, which will affect liquid levels. The inflow relationship considers a number of parameters to arrive at a liquid level prediction; these parameters include injection pressure and temperature, pressures in the producer wellbore, subcool (i.e., cooling of liquid below its saturation temperature) at the heel of the producer, and the vertical temperature gradient (i.e., due to heat loss rate to the underburden, or formation below the production zone). These parameters can be measured directly or indirectly by temperature and pressure sensors placed in the injector and producer wellbores.

The permeability of a heavy oil or oil sands reservoir is non-uniform, or "heterogeneous". Areas with high permeability will tend to allow steam and oil to flow more easily through them; thus these areas are more likely to be depleted sooner than areas with low permeability. Commonly used producer completion strategies provide little restriction to inflow from high permeability areas, so it is likely that reservoirs will be depleted non-uniformly over the length of the well. This could lead to ineffective placement or distribution of steam during the life of the well, which would reduce the overall efficiency of the process. The ideal case is for the reservoir to be depleted uniformly.

The present disclosure teaches methods facilitating the design or selection of means to limit liquid inflow into the producer well from high permeability areas and to control flow from areas with different permeabilities based on liquid level to match reservoir delivery rate. For example, methods in accordance with the disclosure can be used:

- To determine the liquid level required in areas of different permeabilities so that they will produce uniformly;
- To determine the fluid level required to match production to different reservoir delivery rates in a homogeneous reservoir;
- To compare the production distribution for a measured fluid level distribution (for example, by temperature monitoring or logs) with the reservoir delivery distribution to determine the transient behaviour of the fluid level; and/or
- To determine the transient production distribution based on changes in the temperature distribution.

According to one embodiment of methods in accordance with the present disclosure, wellbore flows can be designed to match reservoir delivery. Using this method to determine production rate provides a basis for confirming the completion design and adjusting the design to maintain the production distribution. In this way, growth of the steam chamber can be promoted to be uniform. Alternatively, custom growth patterns can be promoted to accommodate specific geological settings for optimal recovery. Depleting the reservoir uniformly will promote uniform steam chamber growth. This is particularly beneficial for wells with water or gas caps that "rob" steam from the steam chamber rather than allowing the steam to be used as intended (i.e., for heating bitumen at the edge of the steam chamber).

Liquid level is a function of a number of parameters including injector pressure, formation heat loss rate, production rate, permeability, and producer wellbore pressure. Injector pressures are set by the well operator to be higher than the original reservoir pressure to allow for steam to enter the pore spaces within the formation. Injection pressures are limited by the fracture pressure of the formation, which is a function of well depth and overburden geology. Higher injection pressures allow for higher steam chamber temperatures. The pressure acting down on the liquid at the liquid-steam interface is expected and presumed to be close to the injector wellbore pressure.

Formation heat loss rates are governed by the heat conductivity of the underburden geology below the producer well. For a reservoir with bottom water below the producer well, heat losses may be higher and therefore the vertical temperature gradients will be higher.

Producer wellbore pressure and production rates are linked. As production rates are increased, wellbore pressures will decrease. Pressure losses of oil and water will occur as they travel downwards through the liquid trap. Pressure losses are associated with flow through porous media, typically calculated in accordance with Darcy's Law. Additional pressure losses in the liquid trap can occur due to flow convergence from the liquid trap into the openings on the horizontal liner of the producer, from plugging of openings in the horizontal liner, fines migration, relative permeability effects, or other causes.

The rates at which these temperatures and pressures decrease are generally outside the control of the well designer. However, the well designer can control the wellbore pressures through design of the producer well completion. For example, a conventional producer completion may use 88.9 mm tubing landed at the toe of the well. If this tubing diameter is increased to 139.7 mm, then pressure losses through the tubing will be lower. Wells are often controlled to a subcool at the heel of the well, which is typically between 5° C. to 20° C. Subcool at the sand face will be higher as pressure loss through the tubing results in higher pressures at the sand face. For a well with 88.9 mm tubing higher tubing pressure losses will occur, which will result in higher liquid levels. By contrast, a wellbore with 139.7 mm tubing will have less pressure loss and therefore a lower subcool at the sand face.

The preceding example demonstrates the effect of wellbore pressure on sand face subcool and consequently on liquid level. The same principles can be applied to more complicated wellbores with flow control devices mounted on the tubing string or on the liner. The sizing and positioning of flow control devices in the wellbore will affect the direction and magnitude of flow at different points in the wellbore, thus affecting the wellbore pressures.

To maximize production, liquid levels can be designed to be as close to the producer wellbore as possible without causing steam breakthrough. Higher liquid levels will provide greater pressure to drive gravity drainage.

An iterative method can be applied to predict the liquid level height for an expected pressure and temperature gradient through the liquid zone and a known production rate and injector-producer pressure differential. This calculation can be applied over the well length to determine a liquid level distribution for different completion scenarios. Producer wellbore completions can be optimized to raise liquid levels in areas where production needs to be restricted, and completions can be designed to lower liquid levels in areas where production needs to be increased.

Gravity IPR

The Gravity IPR (Inflow Performance Relationship) relates the pressure difference between the steam chamber and the production wellbore to the flow rate into the production wellbore. Developing or characterizing the Gravity IPR involves using temperature measurements from the field to define an analysis boundary encompassing the production wellbore and part of the liquid inventory (i.e., sump or steam trap) surrounding the wellbore. The relationship between pressure difference and inflow rate is then determined using numerical or analytical methods. The Gravity IPR has several unique features when compared to a conventional IPR:

By using temperature measurements to define the analysis boundary, the Gravity IPR couples the drainage radius to the temperature of the fluid entering the wellbore (inflow temperature) such that a higher inflow temperature corresponds to a smaller drainage radius, and a lower inflow temperature corresponds to a larger drainage radius.

The Gravity IPR accounts for the viscosity gradient in the liquid inventory surrounding the wellbore, providing a better approximation of the flow resistance in the near-wellbore region.

The Gravity IPR accounts for the effect of gravity, allowing a stable range of inflow temperatures to be identified, within which the liquid inventory will move towards an equilibrium state where the inflow rate matches the rate at which liquid is delivered to the inventory (delivery rate).

Accordingly, in one aspect the present disclosure teaches a method for characterizing an inflow performance relationship relating the vertical position of the liquid level of a liquid inventory in a steam chamber in a petroleum-bearing formation relative to a horizontal producer well disposed within the formation, comprising the steps of:

measuring temperatures within the steam chamber;

measure the vertical temperature gradient in the liquid inventory;

defining the temperature drawdown as the difference between the steam chamber temperature and the temperature of liquids flowing into the producer well;

defining an analysis boundary in a plane perpendicular to the producer well, such that the analysis boundary encompasses the producer wellbore and contacts the fluid interface between the liquid inventory and the overlying steam chamber;

mapping the measured steam chamber temperature and vertical temperature gradient onto the area enclosed by the analysis boundary;

defining the pressure drawdown as the difference between the steam chamber pressure and the wellbore pressure; and determining the relationship between the pressure drawdown and the flow rate into wellbore, using known numerical or analytical methods.

In one embodiment of the method, the temperature at the fluid interface is assumed to equal the steam chamber temperature, and the temperatures at locations within the analysis boundary are calculated from the vertical temperature gradient and the distance below the fluid interface.

In another embodiment, the pressure at the fluid interface is assumed to equal the steam chamber pressure, and the sum of the pressure head and the elevation head is assumed to be constant along the analysis boundary.

In a further embodiment, the steam chamber pressure is assumed to equal the saturation pressure corresponding to the measured steam chamber temperature.

The analysis boundary may be assumed to be a cylindrical boundary centred on the producer wellbore and touching the lowest part of the fluid interface. However, methods in accordance with the present disclosure are not limited to this assumption, and alternative embodiments of the method may assume a different shape for the analysis boundary.

The methods may include the additional steps of determining the relationship between the pressure drawdown and the inflow rate at a plurality of temperature drawdowns, and then plotting the inflow rate as a function of inflow temperature for a constant pressure drawdown.

Axial Flow Relationship

In addition to flowing radially from the fluid interface to the producer well, liquid may flow axially (i.e, parallel to the producer well) through the near-wellbore reservoir. For purposes of this patent specification, axial flow through the near-wellbore reservoir will be alternatively referred to as "cross-flow". The steps comprising the characterization of the gravity IPR—namely, temperature measurements, analysis boundary definition, temperature mapping, and numerical or analytical analysis—also enable accurate calculation of the axial hydraulic conductivity of the liquid inventory and, in turn, the axial flow rate.

Accordingly, in another aspect the present disclosure teaches a method for characterizing an axial flow relationship relating the conditions at two axial locations along a horizontal producer well disposed within a petroleum-bearing formation to the axial flow rate through a liquid inventory surrounding the producer well, comprising the steps of:

characterizing the gravity IPR at two axial locations along the producer well;

evaluating the axial hydraulic conductivity of the liquid inventory at both locations;

interpolating to approximate the axial hydraulic conductivity of the liquid inventory between the two locations; and calculating the axial flow rate through the liquid inventory as the product of the axial hydraulic conductivity, effective axial hydraulic gradient, and mean flow area.

In one embodiment of the method, the axial hydraulic conductivity of the liquid inventory between the two locations is taken as the average of the axial hydraulic conductivity at the first location and the axial hydraulic conductivity at the second location.

In another embodiment, when conditions other than the liquid level are approximately equal at the two locations, the axial hydraulic conductivity of the liquid inventory at the first location is assumed to equal the axial hydraulic conductivity at the second location and, in turn, the axial hydraulic conductivity between the two locations.

In another embodiment, the effective axial hydraulic gradient between the two locations is taken as the difference between the liquid level at the first location and the liquid level at the second location, divided by the axial distance between the two locations.

In a further embodiment, the gravity IPR is characterized at plurality of axial locations along the producer well, and an axial flow relationship is characterized for each pair of adjacent locations to create a system of axial flow relationships.

BRIEF DESCRIPTION OF THE DRAWINGS

Embodiments of the invention will now be described with reference to the accompanying figures, in which numerical references denote like parts, and in which.

DETAILED DESCRIPTION

Figure 1:
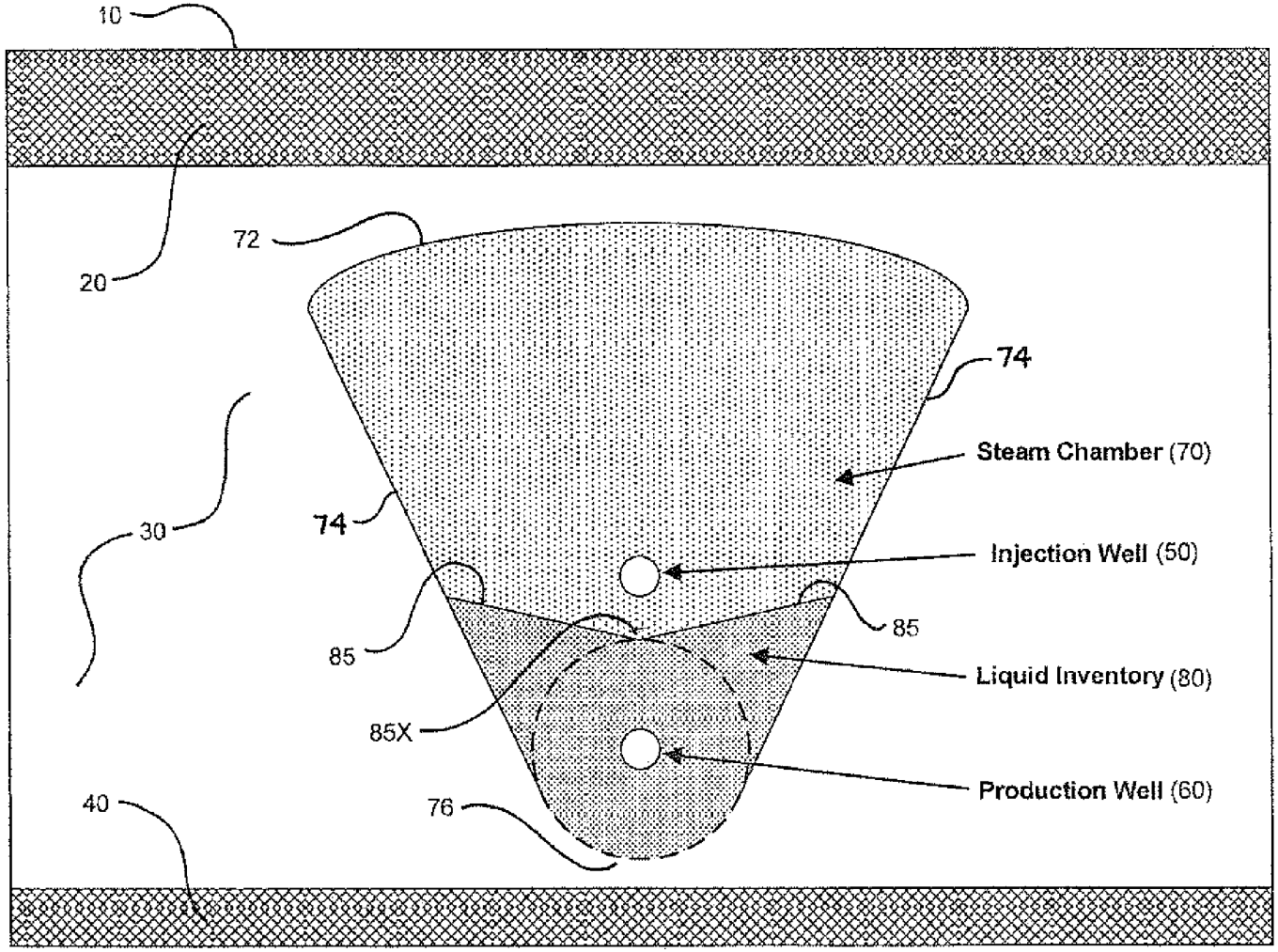
FIG. 1 is a schematic cross-section through a steam chamber within a subterranean oil sands reservoir, in conjunction with a horizontal steam injection well and a horizontal production well.

FIG. 1 schematically illustrates a horizontal well pair (i.e., injector and producer) in a typical SAGD bitumen recovery installation in a bitumen-laden subterranean oil sands formation 30 underlying an overburden layer 20 extending to the ground surface 10, and overlying an underburden formation 40, all in accordance with prior art knowledge and well within the understanding of persons of ordinary skill in the art. Steam under high pressure is introduced into injector well 50 from a connecting well leg (not shown) extending to ground surface 10. Injector 50 has a slotted or orificed liner such that steam exits injector 50 through the liner slots or orifices and permeates oil sands formation 30 to create a steam chamber 70 within formation 30. In this context, the term "steam chamber" may be understood to mean a volume within formation 30 in which steam remains present and mobile, at least for so long as steam injection into formation 30 continues. For analytical purposes, it is assumed that regions of formation 30 outside steam chamber 70 are essentially uninfluenced by the steam injected through injector 50.

The pattern of steam migration within formation 30, and thus the configuration of steam chamber 70, will vary with a variety of factors including formation characteristics and steam injection parameters. However, as represented by the idealized configuration shown in FIG. 1, a typical steam chamber 70 for a SAGD well can be considered or modeled as being generally wedge-shaped in cross-section, surrounding injector well 50, with a "roofline" 72 and sloping side boundaries 74 converging downward toward a lower limit 76. Steam migrating to steam chamber side boundaries 74 condenses due to the lower temperature of the surrounding region of formation 30. As the steam condenses, it transfers energy to the bitumen, increasing its temperature and thus decreasing its viscosity such that it becomes flowable, whereupon the mobile bitumen and condensate flow downward and accumulate as a liquid inventory 80 within a lower region of steam chamber 70, below injector 50. A fluid interface 85 is thus formed between liquid inventory 80 and the overlying region of steam chamber 70. Based on theory and field observation, the level of fluid interface 85 is assumed for analytical purposes to be lowest (i.e., closest to producer 60) at a point 85X directly above producer 60.

A producer well 60 is installed at a selected depth below and generally parallel to injector 50, such that it can be expected to lie within the zone of liquid inventory 80 upon formation of steam chamber 70. Producer well 60 has slots or other suitable orifices to allow the bitumen/condensate mix in liquid inventory 80 to enter producer 60 for production to the surface 10. For this purpose, producer well 60 typically has a liner with narrow slots or other orifices that allow liquid flow into producer 60 while substantially preventing sand or other contaminants from entering producer 60 or clogging the slots or orifices in the liner.

Figure 2:
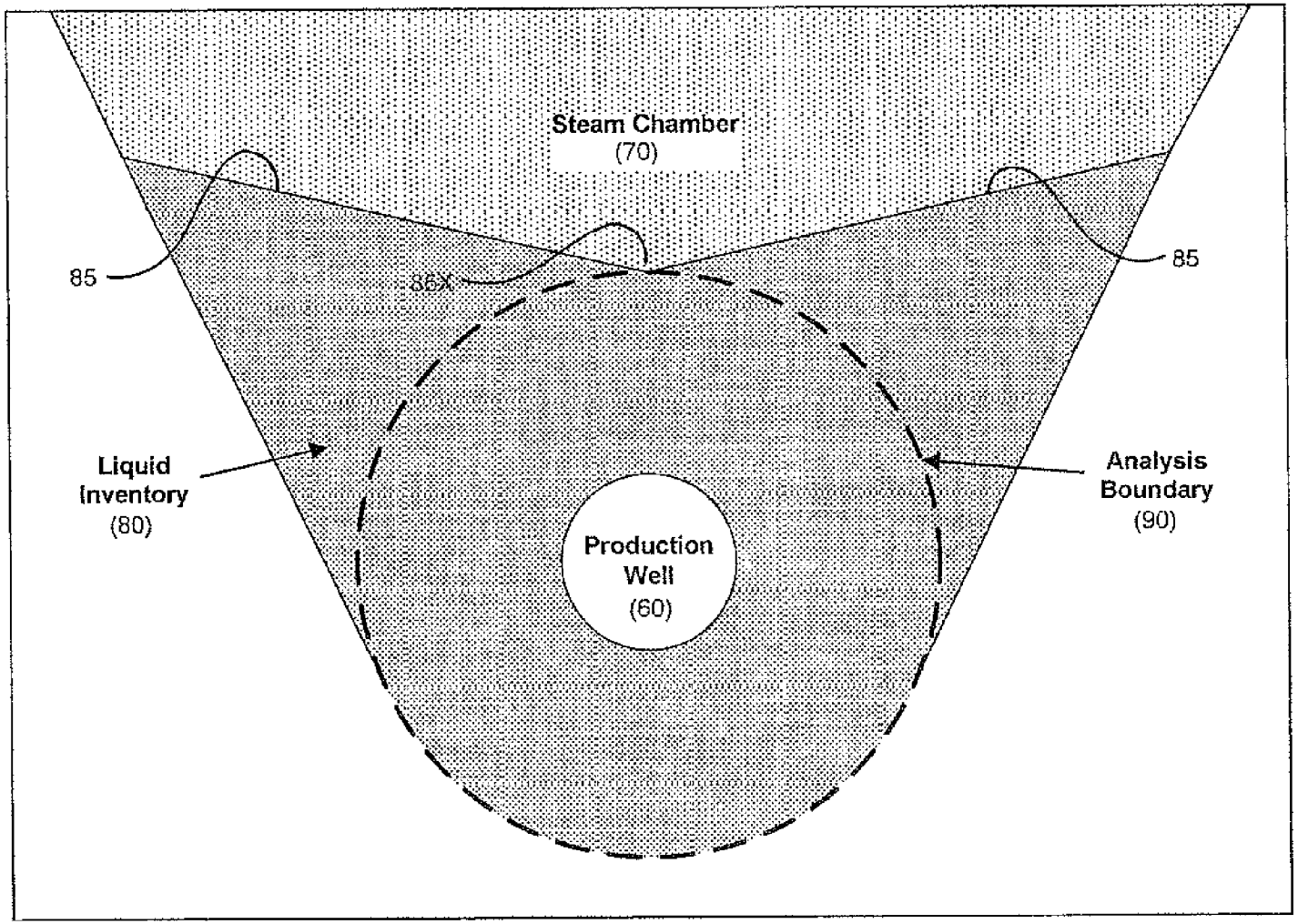
FIG. 2 is an enlarged cross-section through a production well and adjacent regions as in FIG. 1.

FIG. 2 provides an enlarged illustration of liquid inventory 80 and producer well 60 within a lower region of steam chamber 70. Also indicated in FIG. 2 is an analysis boundary 90 surrounding producer well 60, with analysis boundary 90 being an empirically defined or selected parameter for purposes of predictive methods in accordance with the present disclosure. In accordance with a preferred embodiment of these predictive methods, analysis boundary 90 is assumed to be circular in cross-section and centered around producer well 60, with a radius corresponding the distance from the center of producer 60 to point 85X on fluid interface 85. However, alternative configurations of analysis boundary 90 may be appropriate to satisfy case-specific physical and/or analytical constraints.

Gravity Inflow Performance Relationship (Gravity IPR)

Figure 3:
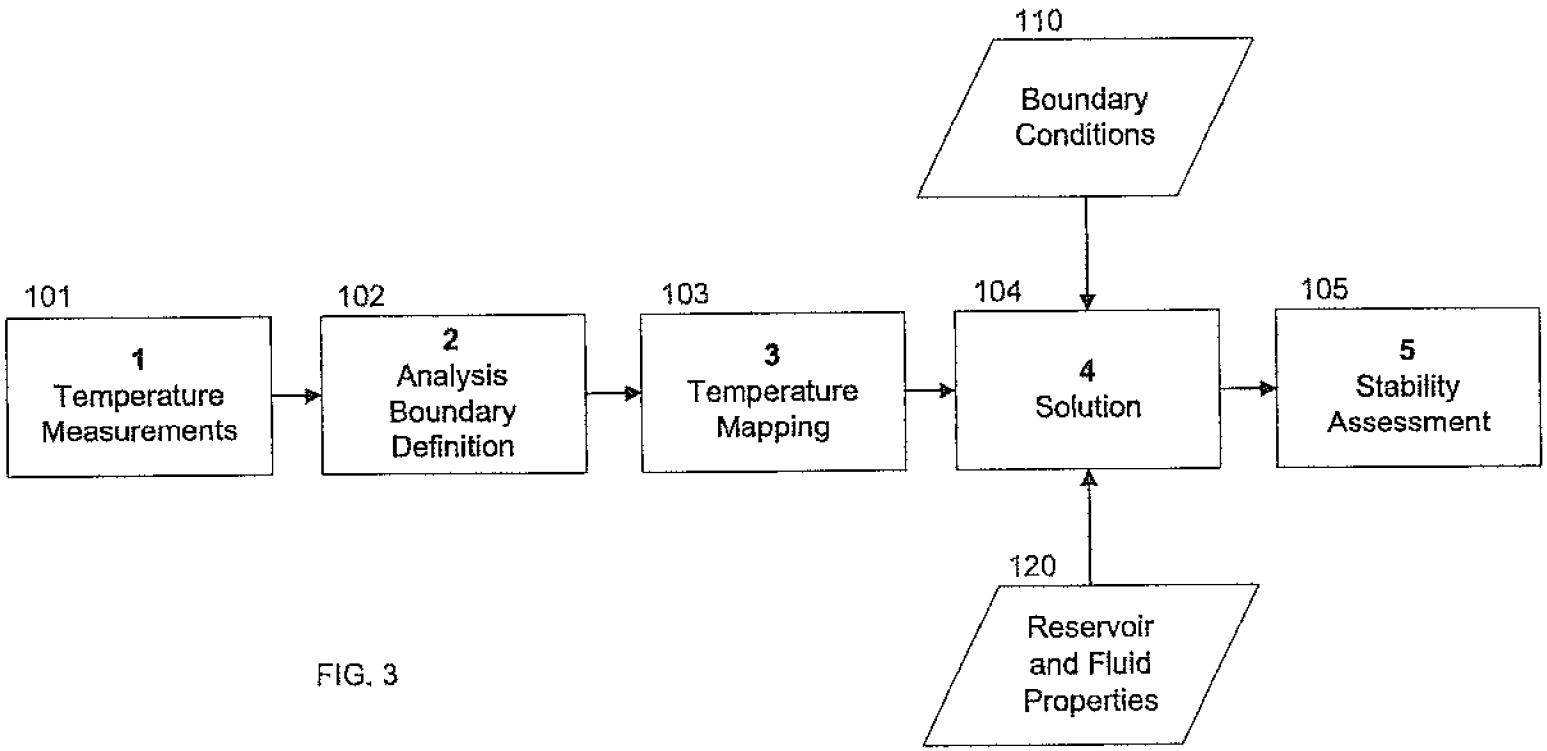
FIG. 3 is a flow chart illustrating steps in one embodiment of a method for establishing an inflow performance relationship for a production wellbore in accordance with the present disclosure.

FIG. 3 schematically illustrates one embodiment of a procedure for developing a "gravity IPR" for use in evaluating the stability of liquid inventory 80. In this context, the stability of liquid inventory 80 relates to the stability of the vertical distance from producer 60 to point 85X on fluid interface 85 at given points along the horizontal length of producer 60 (which for purposes of FIG. 2 corresponds to the radius of circular analysis boundary 90). Procedural and analytical steps shown in FIG. 3 are summarized below:

Stage 101—Temperature Measurements:

- Measure temperatures within steam chamber 70 and the vertical temperature gradient in liquid inventory 80.
- Define the temperature drawdown to be the difference between the steam chamber temperature and the inflow temperature (i.e., temperature of produced fluids flowing into producer well 60). For this purpose:
  - Temperature drawdown=steam chamber temperature−inflow temperature.

Stage 102—Define Analysis Boundary:

- Consider a cross-section of producer wellbore 60 and the surrounding liquid inventory 80 in a plane perpendicular to the axis of the wellbore. Define analysis boundary 90 such that it encompasses producer wellbore 60 and contacts fluid interface 85 between liquid inventory 80 and the overlying steam chamber 70. The distance between producer wellbore 60 and fluid interface 85 (i.e., the liquid level) is given by the temperature drawdown and the vertical temperature gradient. For this purpose:

Liquid level=temperature drawdown/vertical temperature gradient.

Stage 103—Temperature Mapping:

Map the measured steam chamber temperature and vertical temperature gradient onto the area enclosed by analysis boundary 90. For this purpose:

The temperature at liquid-vapor interface 85 is assumed to equal the steam temperature.

The temperature at locations within analysis boundary 90 is calculated from the vertical temperature gradient and the distance below the liquid-vapor interface 85.

Stage 104—Solution:

Specify the pressure conditions at analysis boundary 90 and producer wellbore 60. Define the pressure drawdown to be the difference between the steam chamber pressure and the wellbore pressure. Using numerical or analytical methods known to persons of ordinary skill in the art, determine the relationship between the pressure drawdown and the flow rate into wellbore 60. For this purpose:

The pressure at liquid-vapor interface 85 is assumed to equal the pressure within steam chamber 70 (which is taken to be the saturation pressure corresponding to the measured steam chamber temperature).

The total head (i.e., the sum of the pressure head and the elevation head) is assumed to be constant along analysis boundary 90.

A skin factor is included to account for near-wellbore pressure losses that are measured in the field but not captured by conventional equations for flow through porous media (e.g., Darcy's Law). "Skin factor" in this context is a term well understood in the field (see, for example, the definition of skin factor in the Schlumberger Oilfield Glossary: www.glossary.oilfield.slb.com).

Flow chart blocks 110 and 120 in FIG. 3 represent additional criteria taken into consideration in the solution stage 104:

Block 110—The analysis boundary represents a uniform head (i.e., a flow isobar), and flow normal to the boundary integrated around the perimeter of the boundary defines the inflow to the wellbore. In its simplest form, it is a cylindrical boundary centered on the producer wellbore and touching the lowest part of the fluid interface. Other shapes for the analysis boundary can be incorporated to reflect better conformance to a different fluid level interface, if additional refinement to reflect a changing steam chamber shape with time is desired.

Block 120—Reservoir and fluid properties are calculated over the range of temperatures considered inside the analysis boundary. Relative permeability properties are incorporated and in combination with the temperature field and fluid portions in determining the pressure gradients that are integrated to arrive at the inflow characterization.

Figure 4:
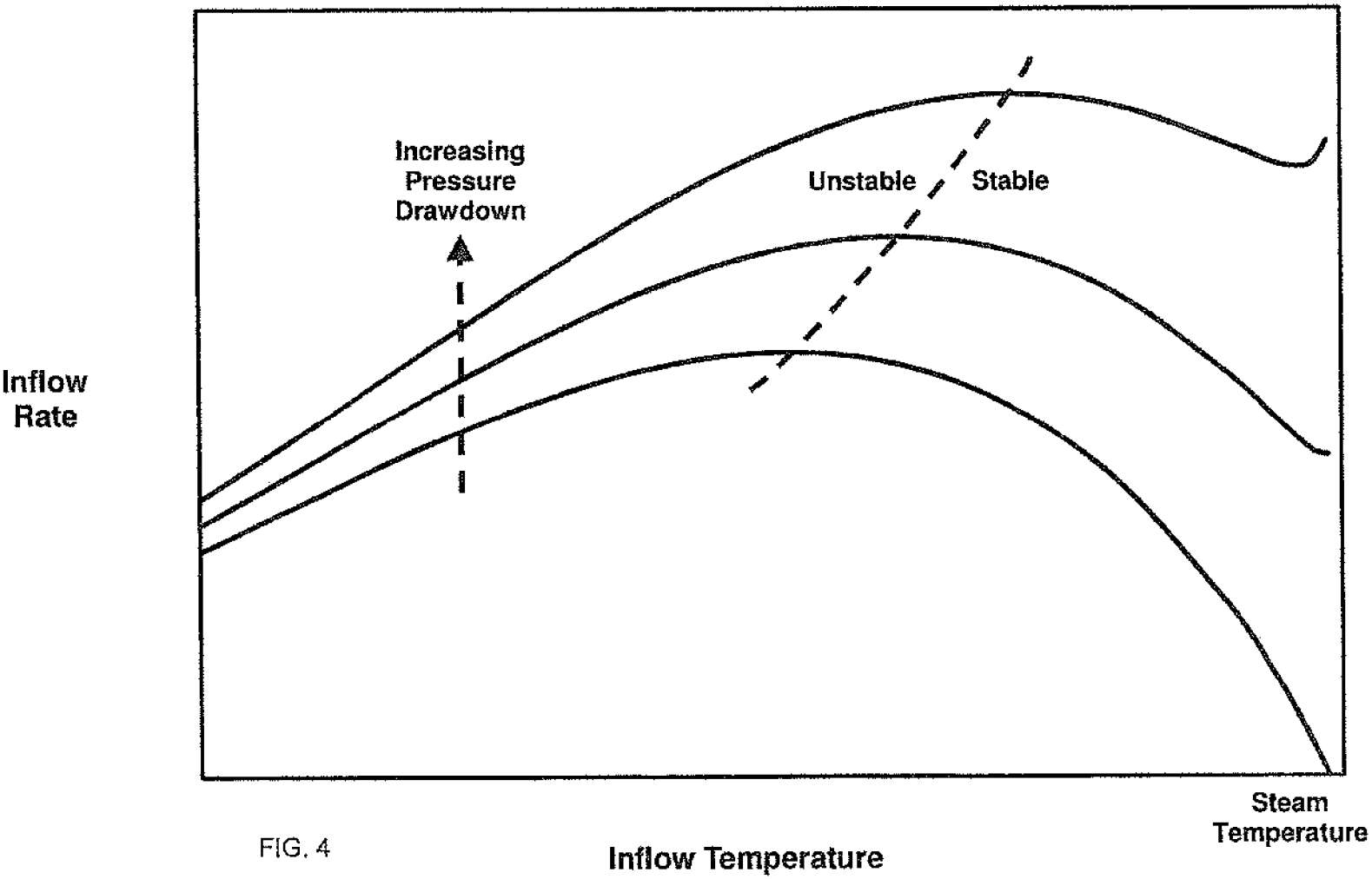
FIG. 4 is a graph illustrating the variability of inflow rate into a production well with changes in inflow temperature.

Stage 105—Stability Assessment:

Determine the relationship between the pressure drawdown and inflow rate at various temperature drawdowns. Plot inflow rate as a function of inflow temperature for a constant pressure drawdown, as shown in FIG. 4. The slope of the plotted curve(s) is negative in the stable range of inflow temperatures.

Within the stable range of inflow temperatures, an increase in liquid level (resulting when the delivery rate into liquid inventory 80 exceeds the inflow rate into producer well 60) will cause the inflow rate to increase. The liquid level will rise until it reaches an equilibrium position at which the inflow rate matches the delivery rate. A decrease in liquid level (resulting when the inflow rate exceeds the delivery rate) causes the inflow rate to decrease. The liquid level will drop until it reaches an equilibrium position at which the inflow rate matches the delivery rate.

Outside the stable range of inflow temperatures, an increase in liquid level will cause the inflow rate to decrease, allowing the liquid level to "run away."

For certain combinations of pressure drawdown, fluid properties, and reservoir properties, the slope of the curve(s) will be positive for all inflow temperatures, indicating that there is no stable range of inflow temperatures. A decrease in liquid level will cause the inflow rate to increase, potentially leading to steam breakthrough into producer 60.

Practical Application of Gravity IPR

When coupled to a wellbore hydraulic model, the gravity IPR enables the performance of a production well to be evaluated by measuring the inflow temperature along the well to determine when the liquid level is reaching critical levels (i.e., when fluid level rise in portions of the well compromises production efficiency, or when fluid level drop in portions of the well compromises well integrity). More specifically, the gravity IPR provides a basis for:

Configuring producer well completions to deliver a pressure distribution that is within the range of self-balancing performance over the life of the well.

Evaluating how pump intake subcool should be controlled to maintain hydraulic conditions within the self-balancing range of operation over the entire well.

Evaluating production rate capacities for specific completion options and field applications.

Using inflow temperature distributions for evaluating completion configuration changes to match reservoir variations and maintain performance within the self-balancing range over the entire well.

Using temperature fall-off logs for evaluating completion configuration changes to match reservoir variations and maintain performance within the self-balancing range over the entire well.

Using temperature measurements to set "smart well" controls for production wells and maintain performance within the self-balancing range over the entire well.

Positioning or repositioning tubing intake points to maintain performance within the self-balancing range over the entire well.

Adjusting chokes on gas lift tubing based on intake temperature to maintain performance within the self-balancing range over the entire well.

Determining where fluid conditions approach water saturation, leading to flashing, which in turns chokes flow to automatically regulate inflow.

By using flow conditions in the GIPR assessment, determining locations where pore throat water flashing may produce scaling and inflow restrictions.

The gravity IPR also provides a basis for determining reservoir delivery distribution over the length of the steam chamber:

For producer wells operating in the self-balancing range, the delivery distribution can be calculated from temperature fall-off logs and inflow distributions using distributed temperature measurements under static inflow conditions.

For wells operating in the dynamic range, the reservoir delivery distribution can be calculated from the inflow rate to the well and the transient behaviour of the fluid level.

Transient plugging development (for example, plugging of slots/orifices in the liner, or plugging in the formation itself by way or pore throat plugging) can be determined using temperature measurements and the gravity IPR. Producer well configuration updates can be evaluated to:

Assess the likelihood of maintaining the well in the self-balancing performance envelope and the reconfiguration requirements to maintain stability.

Determine a production intervention schedule to maintain an efficient production distribution under dynamic fluid level control.

Other analytical methods for describing the inflow performance of the SAGD or any other gravity process can be calibrated using methods in accordance with the present disclosure. For example a conventional IPR inflow performance relationship can be calibrated by determining the drainage radius in the basic IPR equation as a function of inflow temperature. This can provide an even simpler basis for evaluating SAGD inflow performance. One example of such an application would be wellbore hydraulics programs used for analyzing and optimizing completions for SAGD production.

Axial Flow Relationship

Figure 5:
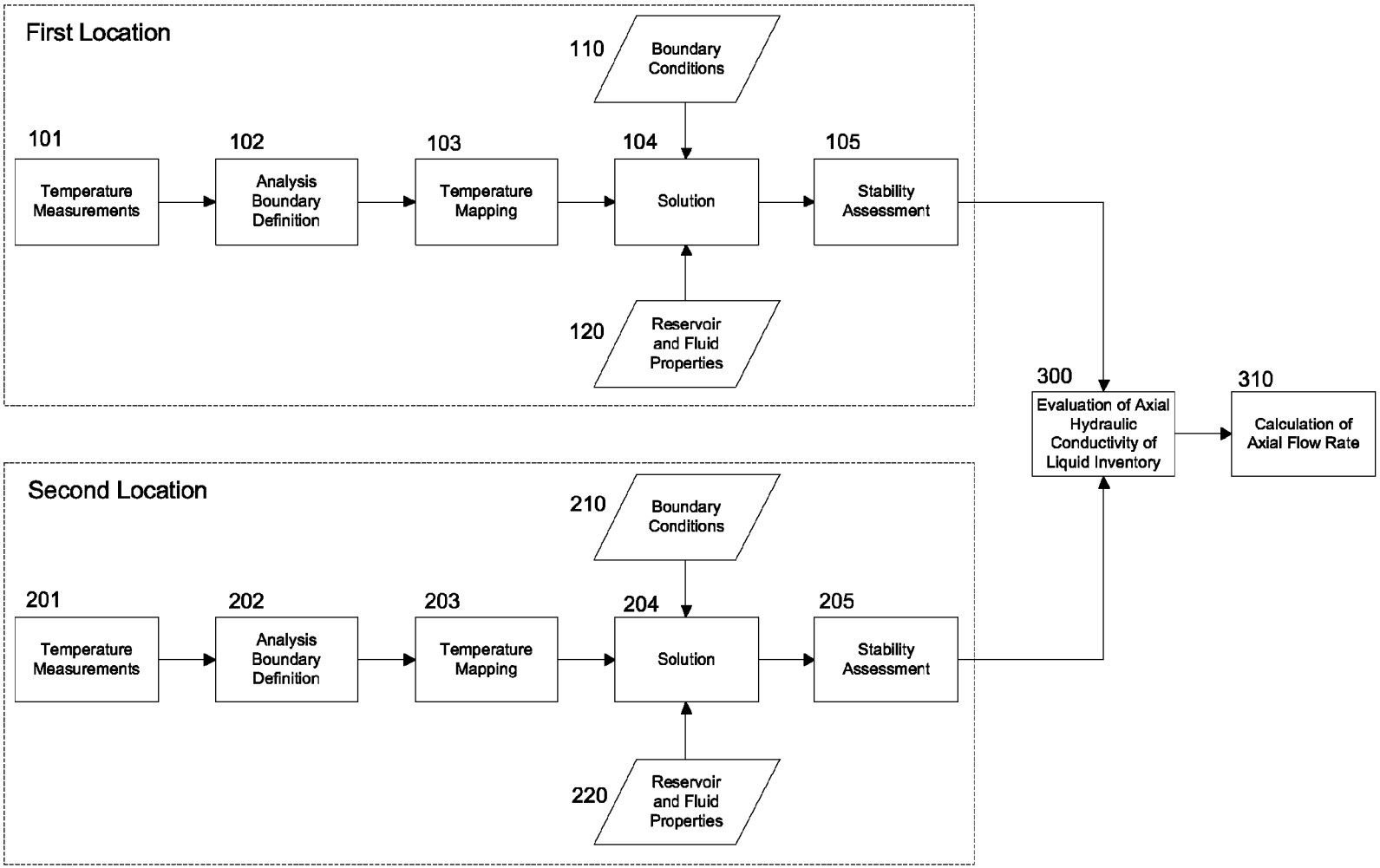
FIG. 5 is a flow chart illustrating steps in one embodiment of a method for establishing an axial flow relationship for a liquid inventory surrounding a production wellbore in accordance with the present disclosure.

FIG. 5 schematically illustrates one embodiment of a procedure for developing an axial flow relationship for use in predicting the axial flow rate through liquid inventory 80. In FIG. 5, reference numbers 101-105, 110, and 120 correspond to the same reference numbers in FIG. 3, specifically in the context of a first location along a producer well. Reference numbers 201-205, 210, and 220 similarly correspond to flow chart blocks 101-105, 110, and 120 in the context of a second location along the producer well. Procedural and analytical steps shown in FIG. 5 are summarized below:

Characterization of Gravity IPR at Two Axial Locations:

Characterize the gravity IPR at two axial locations along producer well 60:

Measured or estimated conditions at the two locations (for example, steam chamber temperature, vertical temperature gradient, fluid properties, or reservoir properties) will be used to approximate conditions in the liquid inventory between the two locations. The greater the distance between the two locations, the greater the uncertainty in this approximation.

An analysis boundary suitable for characterization of the gravity IPR may not be appropriate for characterization of the axial flow relationship. When liquid flows radially from fluid interface 85 to producer well 60, the pressure gradient is largest near producer well 60, where the flow area is smallest and the fluid viscosity is highest (because the temperature decreases from fluid interface 85 to producer well 60). Consequently, conditions in the part of liquid inventory 80 near producer well 60 will have a greater influence on the gravity IPR than conditions in other parts of liquid inventory 80. By contrast, the axial flow relationship will be most strongly influenced by conditions in the part of liquid inventory 80 near fluid interface 85, where the temperature is highest and the fluid is most mobile. Therefore, for characterization of the axial flow relationship, analysis boundary 90 should be expanded to include the part of liquid inventory 80 near fluid interface 85.

For purposes of characterizing an axial flow relationship, the axial hydraulic conductivity may be calculated at numerous points in liquid inventory 80 and analysis boundary 90 defined according to an axial hydraulic conductivity criterion. For example, the analysis boundary may be drawn along a contour of constant axial hydraulic conductivity to encompass only the part of the liquid inventory where the axial hydraulic conductivity is greater than a specified minimum value. The axial hydraulic conductivity criterion may alternatively be expressed in terms of an axial hydraulic conductivity ratio—for example, the ratio of the local axial hydraulic conductivity to the maximum axial hydraulic conductivity.

Evaluation of Axial Hydraulic Conductivity of Liquid Inventory—Block 300:

Evaluate the axial hydraulic conductivity of the part of liquid inventory 80 enclosed by analysis boundary 90 at both axial locations, using numerical or analytical methods known to persons of ordinary skill in the art. The axial hydraulic conductivity is the proportionality constant relating the axial flow velocity and the axial hydraulic gradient.

Interpolate to approximate the axial hydraulic conductivity of liquid inventory 80 between the two axial locations. For this purpose:

The axial hydraulic conductivity of liquid inventory 80 between the two axial locations is taken as the average of the axial hydraulic conductivity at the first location and the axial hydraulic conductivity at the second location.

When conditions other than the liquid level (for example, the steam chamber temperature, vertical temperature gradient, fluid properties, and reservoir properties) are approximately equal at the two locations, the axial hydraulic conductivity of liquid inventory 80 at the first location may be assumed to equal the axial hydraulic conductivity at the second location and, in turn, the axial hydraulic conductivity between the two locations. By extension, when conditions other than the liquid level are approximately uniform along producer well 60, the axial hydraulic conductivity of liquid inventory 80 need only be evaluated at one axial location. Variations in the liquid level will shift the mobile part of liquid inventory 80 vertically but will not significantly affect the axial hydraulic conductivity.

Calculation of Axial Flow Rate—Block 310:

Calculate the axial flow rate through liquid inventory 80 as the product of the axial hydraulic conductivity, effective axial hydraulic gradient, and mean flow area. For this purpose:

The effective axial hydraulic gradient between the two locations is taken as the difference between the liquid level at the first location and the liquid level at the second location, divided by the axial distance between the two locations.

The effective axial hydraulic gradient may account for variations in the axial hydraulic gradient with distance from producer well 60 due to radial flow from fluid interface 85 to producer well 60.

The mean flow area is taken as the average of the areas enclosed by analysis boundary 90 at the two locations.

Practical Application of Gravity IPR with Crossflow

The gravity IPR may be characterized at a plurality of axial locations along the producer well and axial flow relationships developed for each pair of adjacent locations to create a system of axial flow relationships, or axial flow "network". When included in a wellbore hydraulic model coupled with the gravity IPR, an axial flow network enables improved estimation of liquid level variations over time, based not only on an imbalance between the inflow distribution and delivery distribution, but also on the axial redistribution of liquid from locations with a higher liquid level to locations with a lower liquid level.

Practical applications of an axial flow network include:

estimation of the liquid level above blank (i.e., unslotted or unscreened) sections of the producer liner, where liquid must flow axially through the liquid inventory before flowing radially into a slotted section of the liner; and estimation of the liquid level above locations of formation damage, where a reduction in the near-wellbore permeability causes liquid to flow preferentially in the axial direction.

It will be readily appreciated by those skilled in the art that various modifications of methods in accordance with the present disclosure may be devised without departing from the scope and teaching of the present invention. It is to be especially understood that the subject methods are not intended to be limited to any described or illustrated embodiment, and that the substitution of a variant of a claimed element or feature, without any substantial resultant change in the working of the methods, will not constitute a departure from the scope of the invention.

In this patent document, any form of the word "comprise" is to be understood in its non-limiting sense to mean that any item following such word is included, but items not specifically mentioned are not excluded. A reference to an element by the indefinite article "a" does not exclude the possibility that more than one of the element is present, unless the context clearly requires that there be one and only one such element.

Relational terms such as "parallel", "horizontal", and "perpendicular" are not intended to denote or require absolute mathematical or geometric precision. Accordingly, such terms are to be understood in a general rather than precise sense (e.g., "generally parallel" or "substantially parallel") unless the context clearly requires otherwise.

Wherever used in this document, the terms "typical" and "typically" are to be interpreted in the sense of representative or common usage or practice, and are not to be understood as implying invariability or essentiality.

What is claimed is:

1. A method for characterizing an axial flow relationship relating the conditions at two axial locations along a horizontal producer well disposed within a petroleum-bearing formation to the axial flow rate through a liquid inventory surrounding the producer well, comprising the steps of:

(a) characterizing the gravity inflow performance relationship (IPR) at two axial locations along the producer well;

(b) evaluating the axial hydraulic conductivity of the liquid inventory at both locations;

(c) interpolating to approximate the axial hydraulic conductivity of the liquid inventory between the two locations; and (d) calculating the axial flow rate through the liquid inventory as the product of the axial hydraulic conductivity, effective axial hydraulic gradient, and mean flow area.

2. A method as in claim 1 wherein the axial hydraulic conductivity of the liquid inventory between the two locations is taken as the average of the axial hydraulic conductivity at the first location and the axial hydraulic conductivity at the second location.

3. A method as in claim 1 wherein when conditions other than the liquid level are approximately equal at the two locations, the axial hydraulic conductivity of the liquid inventory at the first location is assumed to equal the axial hydraulic conductivity at the second location and, in turn, the axial hydraulic conductivity between the two locations.

4. A method as in claim 1 wherein the effective axial hydraulic gradient between the two locations is taken as the difference between the liquid level at the first location and the liquid level at the second location, divided by the axial distance between the two locations.

5. A method as in claim 1 wherein the gravity IPR is characterized at plurality of axial locations along the producer well, and an axial flow relationship is characterized for each pair of adjacent locations to create a system of axial flow relationships.

* * * * *